US005165570A

United States Patent [19]

Windorski et al.

[11] Patent Number: 5,165,570

[45] Date of Patent: * Nov. 24, 1992

[54] SHEET DISPENSER

[75] Inventors: David C. Windorski, Woodbury; Kenneth J. Kirchhoff, Gem Lake, both of Minn.

[73] Assignee: Minnesota Mining and Manufacturing Company, St. Paul, Minn.

[ * ] Notice: The portion of the term of this patent subsequent to Feb. 19, 2008 has been disclaimed.

[21] Appl. No.: 518,926

[22] Filed: May 4, 1990

Related U.S. Application Data

[63] Continuation-in-part of Ser. No. 358,395, May 26, 1989, Pat. No. 4,993,590.

[51] Int. Cl.[5] ..... B65H 1/04

[52] U.S. Cl. ..... 221/46; 221/45; 221/52

[58] Field of Search ..... 221/33, 44, 45, 47, 221/48, 49, 51, 52, 56, 58, 59, 60, 61, 63, 197, 281, 282

[56] References Cited

U.S. PATENT DOCUMENTS

| | | | |
|---|---|---|---|
| 442,214 | 12/1890 | Allen . | |
| 1,878,399 | 9/1932 | Hope . | |
| 2,464,426 | 3/1949 | Williams | 221/58 |
| 2,592,255 | 4/1952 | Drees . | |
| 3,164,298 | 1/1965 | Repko | 221/282 |
| 3,231,130 | 1/1966 | Foote | 221/70 |
| 3,310,199 | 3/1967 | Roberts et al. | 221/25 |
| 3,370,747 | 2/1968 | Desmond | 221/26 |
| 3,381,853 | 5/1968 | Ferris et al. | 221/63 |
| 3,425,595 | 2/1969 | Shapira | 221/52 |
| 4,191,306 | 3/1980 | Rabner | 221/33 |
| 4,416,392 | 11/1983 | Smith | 221/59 X |
| 4,562,938 | 1/1986 | Loder | 221/46 |
| 4,586,629 | 5/1986 | Loder | 221/46 |
| 4,586,630 | 5/1986 | Loder | 221/46 |
| 4,653,666 | 3/1987 | Mertens | 221/45 |
| 4,674,634 | 6/1987 | Wilson | 221/45 |
| 4,768,810 | 9/1988 | Mertens | 282/12 |
| 4,770,320 | 9/1988 | Miles et al. | 221/33 |
| 4,781,306 | 11/1988 | Smith | 221/33 |
| 4,796,781 | 1/1989 | Windorski | 221/52 X |
| 4,993,590 | 2/1991 | Windorski | 221/45 |

FOREIGN PATENT DOCUMENTS 1016522 11/1952 France .

*Primary Examiner*—David H. Bollinger
*Attorney, Agent, or Firm*—Gary L. Griswold; Walter N. Kirn; William L. Huebsch

[57] ABSTRACT

A dispenser for paper sheets from a stack comprising a plurality of the sheets disposed one on top of another, each sheet having a band of pressure sensitive adhesive coated on one surface adjacent one edge thereof and being free of adhesive coating along a portion adjacent an opposite edge thereof, and the sheets being stacked with the adhesive coating on each successive sheet disposed along alternate opposite sides of the stack and releasably adhering the sheets together to maintain the sheets in the stack. The dispenser has surfaces defining a cavity adapted to receive the stack including opposed end surfaces adapted to be engaged by the opposite sides of the stack, and two spaced friction surface portions extending generally toward each other from the upper ends of the end surfaces which are generally arcuate and concave about an axis parallel to the upper ends of the end surfaces. The dispenser arcs the stack and presses it toward the friction surface portions to afford positioning the uppermost sheets of the stack along the friction surface portions with the adhesive free portion of the uppermost sheet in the stack projecting through the opening so that by grasping that end portion the uppermost sheet on the stack can be manually pulled through the opening and will carry with it the adhesive free end portion of the sheet beneath it in the stack to which the uppermost sheet is adhered by the adhesive coating, placing that adhesive free end portion in a position where it also may be grasped and pulled to withdraw the next sheet from the stack.

11 Claims, 6 Drawing Sheets

SHEET DISPENSER

CROSS REFERENCE TO A RELATED APPLICATION

This application is a continuation-in part of U.S. patent application Ser. No. 07/358,395 filed May 26, 1989, now U.S. Pat. No. 4,993,590.

TECHNICAL FIELD

The present invention relates to dispensers for sheets from a stack of flexible sheet material comprising a plurality of the sheets disposed one on top of another, each sheet having a band of pressure sensitive adhesive coated on one surface adjacent one edge thereof and being free of adhesive coating adjacent an opposite edge thereof, and the sheets being stacked with the adhesive coating on each successive sheet disposed along alternate opposite sides of the stack and releasably adhering the sheets together to maintain the sheets in the stack.

BACKGROUND ART

Dispensers are known for sheets from a stack of flexible sheet material of the type described above. U.S. Pat. Nos. 4,416,392 and 4,796,781 describe such dispensers, each of which include means for positioning a top surface of the stack along a surface of the dispenser with an end portion of the uppermost sheet in the stack projecting through a central opening through that surface so that the uppermost sheet on the stack can be manually withdrawn through the opening and will carry with it the end portion of the sheet beneath it in the stack which then projects through the opening in a position that it too may be withdrawn. In the dispenser described in U.S. Pat. No. 4,416,392 that means is a spring on the side of the stack opposite its top surface, and in the dispenser described in U.S. Pat. No. 4,796,781 that means is a weighted portion of the dispenser providing the central opening that is movable relative to a base portion of the dispenser on which the stack is supported. While both of these dispensers are useful and efficient for dispensing sheet from such a stack, each is either more complex or expensive than may be desired for certain applications.

DISCLOSURE OF INVENTION

The present invention provides a simple, inexpensive and effective dispenser for dispensing flexible sheets from a stack comprising a plurality of the sheets disposed one on top of another, each sheet having a band of pressure sensitive adhesive coated on one surface adjacent one edge thereof and being free of adhesive coating along a portion adjacent an opposite edge thereof, and the sheets being stacked with the adhesive coating on each successive sheet disposed along alternate opposite sides of the stack and releasably adhering the sheets together to maintain the sheets in the stack.

The dispenser according to the present invention comprises walls having surfaces defining a cavity adapted to receive the stack, which surfaces include opposed end surfaces having generally parallel upper ends, which end surfaces being adapted to be engaged by the opposite sides of the stack, two friction surface portions extending generally toward each other from the upper ends of the end surfaces, the friction surface portions being generally arcuate and concave about an axis parallel to the upper ends of the end surfaces, and having ends opposite the end surfaces spaced from and aligned with each other, and opposed outlet surfaces at the ends of the friction surface portions opposite the end surfaces defining an opening through the walls between the friction surface portions. The dispenser includes means adapted for arcing the stack and for pressing the stack toward the friction surface portions to afford positioning the uppermost sheets of the stack along the friction surface portions with the adhesive free portion of the uppermost sheet in the stack projecting through the opening so that by grasping that end portion the uppermost sheet on the stack can be manually pulled through the opening and will carry with it the adhesive free end portion of the sheet beneath it in the stack to which the uppermost sheet is adhered by the adhesive coating, placing that adhesive free end portion in a position where it also may be grasped and pulled to withdraw the next sheet from the stack. The friction surface portions and the means for arcing the stack and for pressing the stack are adapted to restrict sliding movement of the adhesively joined end portions of the uppermost sheet and the sheet beneath it between the stack and the adjacent friction surface portion until a predetermined force is applied to pull the uppermost sheet from the stack, which predetermined force is greater than the force affording pealing separation between the uppermost sheet and the sheet beneath it by pulling only on the uppermost sheet after the uppermost sheet is withdrawn from the dispenser.

Surprisingly, it has been found that using such friction surface portions that are generally arcuate and concave about an axis parallel to the upper ends of the end surfaces, and including means adapted for arcing the stack and for pressing the arched stack toward the arcuate friction surface portions allows sheets to be pulled from the dispenser with a significantly lesser force that when such friction surface portions are planar and the stack is not arched. Thus a dispenser that is intended to sit on a tabletop that includes such friction surface portions that are generally arcuate and concave, and includes such means adapted for arcing the stack and for pressing the arched stack toward the arcuate friction surface portions need not be as heavy to prevent it from being lifted from the table when a sheet is manually pulled from it. Suitable dispensers of this type have been designed that weigh in the rang of 500 to 600 grams.

In two embodiments of the dispenser described herein the means adapted for arcing the stack and for pressing the stack toward the friction surface portions comprises means for mounting a pressure member on the walls defining the cavity with a pressure surface on the pressure member opposite the friction surface portions for movement of the pressure member in a direction generally normal to the friction surface portions between an extended position (to which the pressure member is biased) with the pressure surface closely adjacent the friction surface portions, and a retracted position with the pressure surface spaced from the friction surface portions. In one of those embodiments the walls of the dispenser defining the cavity include a bottom wall defining a bottom surface opposite and spaced from the friction surface portions, the means for mounting the pressure member mounts the pressure member in the base wall for straight line movement between the retracted and extended positions, and the pressure member has a pair of spaced projecting ridges defining the pressure surface and extending parallel to the axis, the ridges being opposite portions of the friction surface portions adjacent the adjacent the outlet surface portions; whereas in another of those embodiments the pressure member is mounted on the base wall for pivotal movement between the retracted and extended positions about a pivot axis disposed at a right angle with respect to the axis parallel to the upper ends of the end surfaces, and the pressure surface is generally arcuate both about a first pressure surface axis at a right angle to the pivot axis and about a second pressure surface axis parallel to the pivot axis to provide a line of contact between the pressure surface and the stack that generally remains centered along the opening as the pressure member moves between the retracted and extended positions.

In another embodiment of the dispenser the means adapted for arcing the stack and for pressing the stack toward the friction surface portions comprises the opposed end surfaces being spaced apart a distance less than the distance between the opposite sides of the stack the dispenser is adapted to receive so that a stack positioned with its sides against the end surfaces will be arched and positioned with the uppermost sheets of the stack along the friction surface portions, and those opposed end surfaces also diverge slightly away from each other (e.g., at an angle of about 12 degrees) toward the upper ends of the end surfaces to cause movement of the end portions of the stack along the end surfaces toward the upper ends in response to forces applied to the stack to sequentially remove sheets from the stack through the opening.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
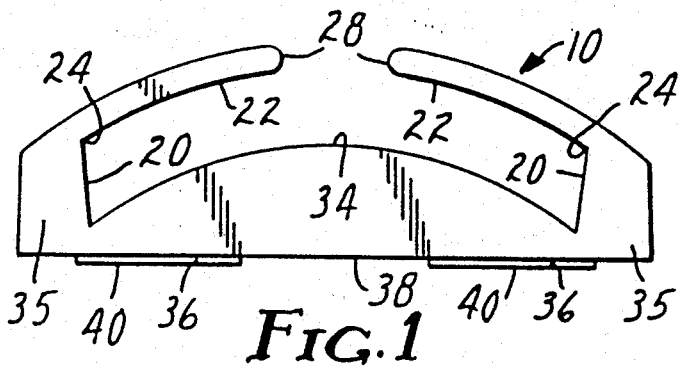
FIG. 1 is a side view of a first embodiment of a sheet dispenser according to the present invention.
Figure 2:
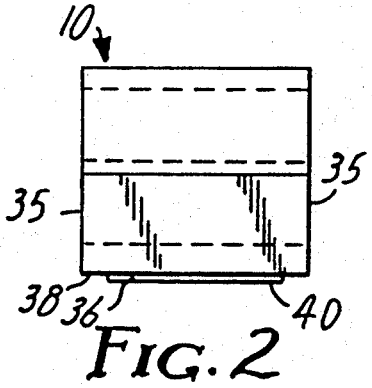
FIG. 2 is an end view of the sheet dispenser shown in FIG. 1.

Referring now to FIGS. 1 through 7 of the drawing, there is shown a first embodiment of a dispenser according to the present invention generally designated by the reference numeral 10.

The dispenser 10 is for dispensing flexible sheets 12 from a stack 14 comprising a plurality of the sheets 12 disposed one on top of another, each sheet 12 having a band of pressure sensitive adhesive coated on a minor portion of one surface adjacent one edge thereof and being free of adhesive coating on a major portion of that surface adjacent an opposite edge thereof, and the sheets 12 being stacked with the adhesive coating on each successive sheet 12 disposed along alternate opposite sides 16 of the stack 14 and releasably adhering the sheets 12 together to maintain the sheets 12 in the stack 14 (e.g., the stack of sheets described in U.S. Pat. No. 4,416,392, the content whereof is incorporated herein by reference).

The dispenser 10 comprises walls having surfaces defining a cavity adapted to receive the stack 14. Those surfaces include opposed planar end surfaces 20 having parallel upper ends 24, which end surfaces 20 are adapted to be engaged by the opposite sides 16 of the stack 14 and are spaced to cause the stack 14 positioned therebetween to be arched; and arcuate friction surface portions 22 that are generally cylindrically concave about an axis, have proximal ends at the upper ends 24 of the end surfaces 20, extend toward each other along an aligned arcuate path from the upper ends 24 of the end surfaces 20, and have spaced distal ends (e.g. spaced by about 1.6 centimeters). Opposed outlet surfaces 28 at the spaced distal ends of the arcuate surface portions 22 define an opening through the walls of the dispenser 10 between the distal ends of the arcuate surface portions 22.

The opposed end surfaces 20 are spaced apart a distance less that the distance between the opposite sides 16 of the stack 10 (e.g., spaced at about 7.39 centimeters (2.91 inches) between the upper ends 24 of the end surfaces 20 for a stack 7.62 centimeters (3 inches) wide between its sides 16) to arc the stack 10 positioned with its sides 16 against the end surfaces 20 and to position the upper most sheets 12 of the stack 10 along the generally arcuate friction surface portions 22 with the adhesive free end portion of the uppermost sheet 12 in the stack 14 projecting through the opening. By grasping that end portion the uppermost sheet 12 of the stack 14 can be manually pulled through the opening and will carry with it the adhesive free end portion of the sheet 12 beneath it in the stack 14, placing that end portion in a position where it also may be grasped and pulled to withdraw the next sheet 12 from the stack 14 through the opening.

Figure 3:
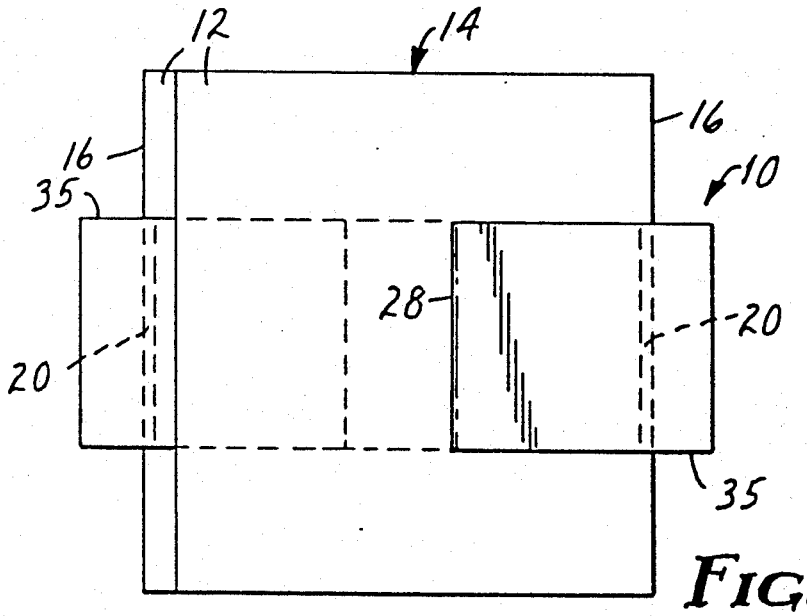
FIG. 3 is a top view of the sheet dispenser of FIG. 1 having a stack of sheets positioned therein.
Figure 4:
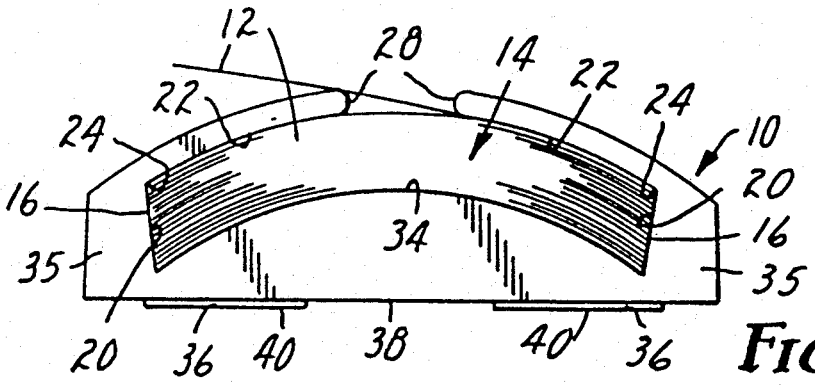
FIG. 4 is a side view of the sheet dispenser as shown in FIG. 3.
Figure 5:
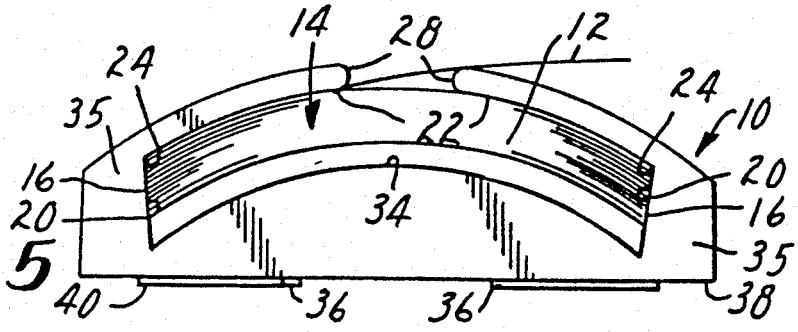
FIG. 5 is a side view of the sheet dispenser as shown in FIG. 4 from which a large number of the sheets in the stack have been dispensed.

The opposed end surfaces 20 against which sides 16 of the stack 14 are engaged diverge slightly from each other toward the upper ends 24 of the end surfaces 20 to cause movement of the sides 16 of the stack 14 along the end surfaces 20 toward their upper ends 24 and the arcuate friction surface portions 22 in response to forces applied to the stack 14 to sequentially remove sheets 12 from the stack 14 through the opening (see FIGS. 3, 4 and 5). To cause such movement of the stack 14, the opposed end surfaces 20 should diverge from each other toward their upper ends 24 at an angle in the range of about 6 to 18 degrees, and preferably at an angle of about 12 degrees. The use of a bottom sheet on the stack 14 that is more stiff than the other sheets 12 in the stack has found to insure movement of the last few sheets 12 in the stack to positions adjacent the upper ends 24 of the end surfaces 20 so that those last few sheets will be dispensed one at a time rather than as a chain of sheets.

Figure 6:
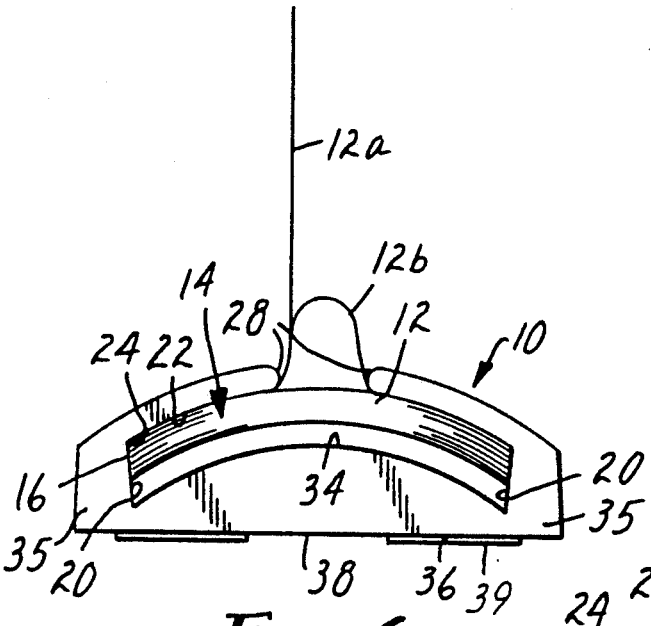
FIGS. 6 and 7 sequentially illustrate the movement of an uppermost sheet and a sheet beneath it in the stack as the uppermost sheet is withdrawn from the dispenser as illustrated in FIG. 5.
Figure 7:
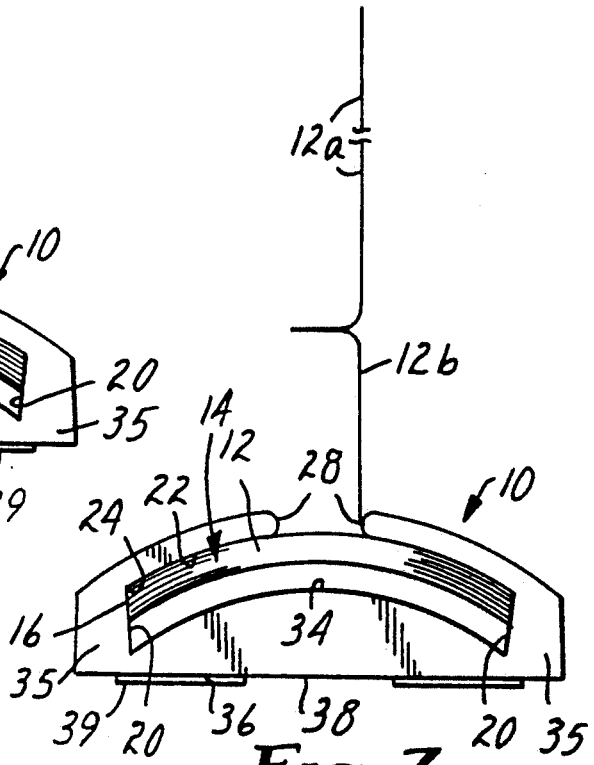
Figure 8:
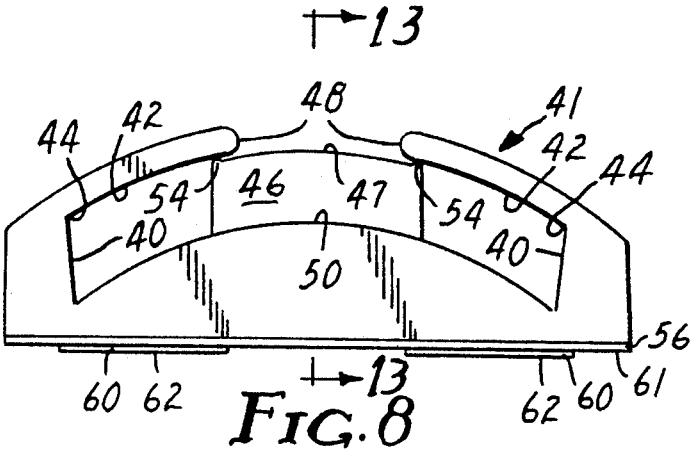
FIG. 8 is a side view of a second embodiment of a sheet dispenser according to the present invention.
Figure 9:
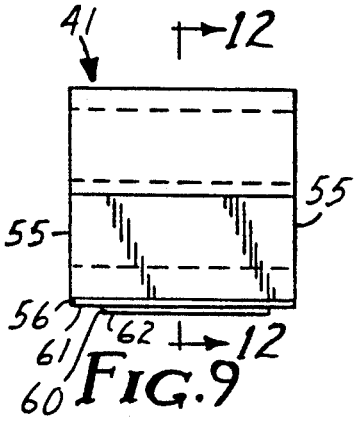
FIG. 9 is an end view of the sheet dispenser shown in FIG. 8.
Figure 10:
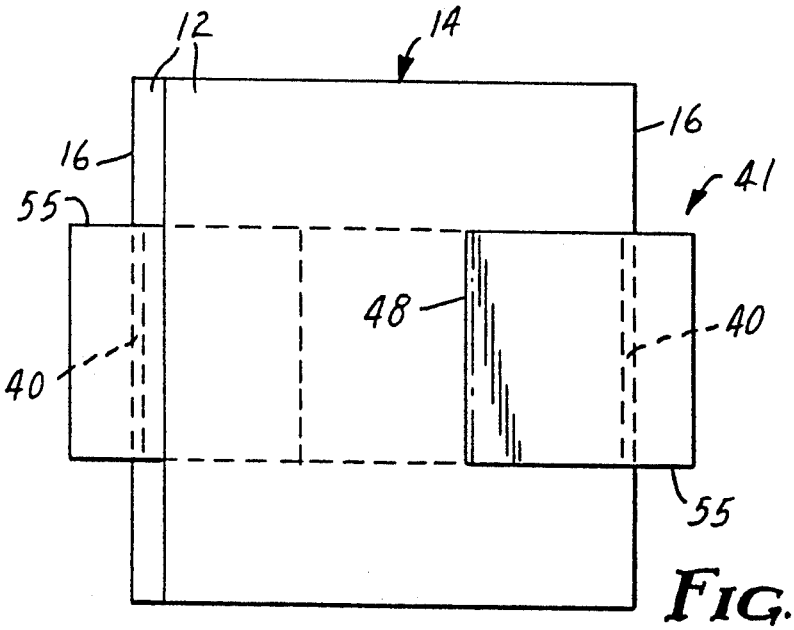
FIG. 10 is a top view of the sheet dispenser of FIG. 8 having a stack of sheets positioned therein.
Figure 11:
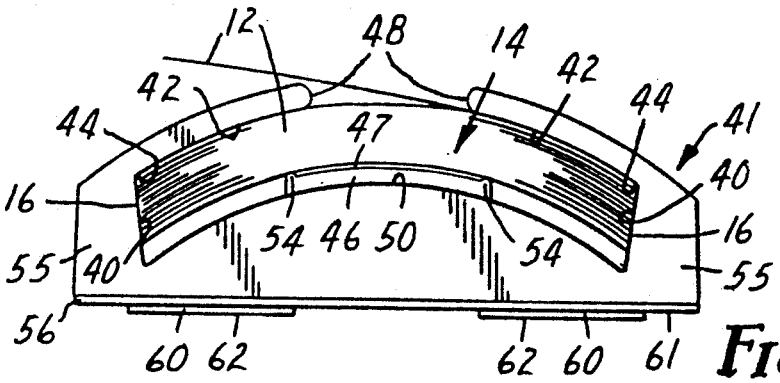
FIG. 11 is a side view of the sheet dispenser as shown in FIG. 10.
Figure 12:
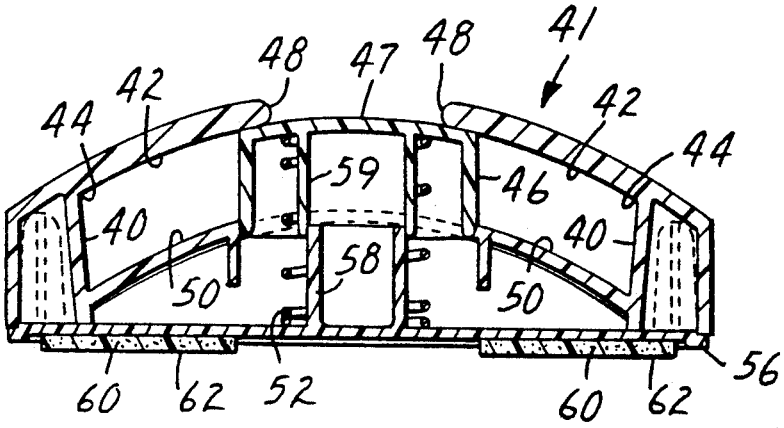
FIG. 12 is a sectional view taken approximately along line 12—12 of FIG. 9.
Figure 13:
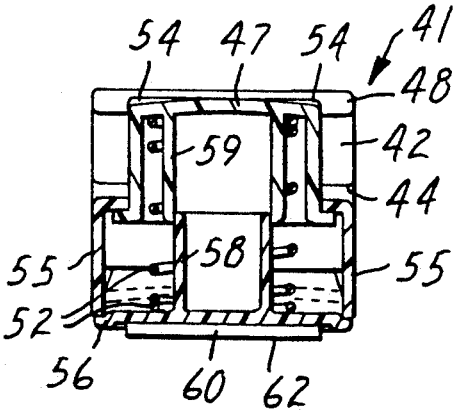
FIG. 13 is a sectional view taken approximately along line 13—13 of FIG. 8.
Figure 14:
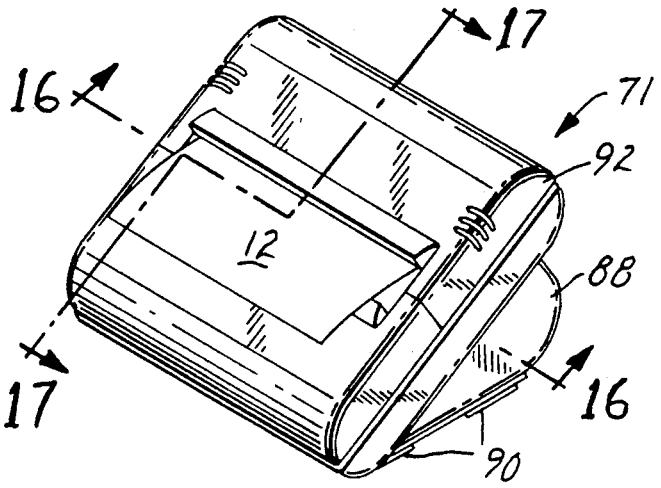
FIG. 14 is a perspective view of a third embodiment of a sheet dispenser according to the present invention.

The friction surface portions 22 are shaped to provide means for affording sliding movement of the adhesively joined end portions of the uppermost sheet 12*a* and the sheet 12*b* beneath it between the rest of the stack 14 and the adjacent friction surface portion 22 as is illustrated in FIG. 6, and for making sufficient frictional engagement with the adhesive coated end portion of the sheet 12 beneath the uppermost sheet 12 to restrict its movement between the rest of the stack 14 and the adjacent friction surface portion 22 to thereby afford pealing separation between the uppermost sheet 12 and the sheet 12 beneath it after the uppermost sheet 12 is withdrawn from the dispenser as is illustrated in FIG. 7.

The walls of the dispenser 10 are included in a unitary structure (e.g., a polymeric molding of polystyrene, or a metal casting or length of an extrusion), and the surfaces further include a bottom surface 34 extending between the ends of the opposed end surfaces 20 opposite their upper ends 24, which bottom surface 34 could be planar between those ends but as illustrated is cylindrically convex about the axis of the arcuate surface portions 22 and is opposed to and generally uniformly spaced from the cylindrically concave arcuate surface portions 22 by a distance slightly more than the thickness dimension of the stack 14 the dispenser 10 is adapted to receive (e.g., 1.5 centimeter). The opposed end surfaces 20, the concave arcuate surface portions 22, the opposed outlet surfaces 28, and the convex bottom surface 34 extend transversely entirely through the dispenser 10 parallel to the axis of the surface portions 22 and bottom surface 34 so that the cavity defined by those surfaces has opposite end openings opening through sides 35 of the dispenser 10, through which end openings the stack 14 can be inserted into the cavity. The dispenser 10 as illustrated can thus have a transverse width less than the width of the stack 14 from which it dispenses sheets (e.g., a width of 3.3 centimeters for a stack having a width parallel to its sides 16 of about 7.62 centimeters).

Means in the form of rectangular foam pads 36 adhered to a base surface 38 of the dispenser 10 and having a coating of pressure sensitive adhesive on their surfaces opposite the base surface 38 that may prior to use be covered with a release liner 40 are provided for adhesively anchoring the dispenser 10 to a substrate. Alternatively, the dispenser 10 could be anchored to a substrate by mechanical means, such as screws, or be made of or filled with a material of sufficient weight that the dispenser would stay in place with its base surface 38 against a horizontal surface while a sheet 12 is withdrawn from it. The dispenser is also useful without such anchoring means, but typically then requires holding the dispenser 10 in one hand while a sheet 12 is withdrawn by the other.

Referring now to FIGS. 8 through 11 of the drawing, there is shown a second embodiment of a dispenser according to the present invention generally designated by the reference numeral 41.

Like the dispenser 10, the dispenser 41 is for dispensing flexible sheets 12 from a stack 14 comprising a plurality of the sheets 12 disposed one on top of another, each sheet 12 having a band of pressure sensitive adhesive coated on a minor portion of one surface adjacent one edge thereof and being free of adhesive coating on a major portion of that surface adjacent an opposite edge thereof, and the sheets 12 being stacked with the adhesive coating on each successive sheet 12 disposed along alternate opposite sides 16 of the stack 14 and releasably adhering the sheets 12 together to maintain the sheets 12 in the stack 14. Like the dispenser 10, the dispenser 41 also comprises walls having surfaces defining a cavity adapted to receive the stack 14. Those surfaces include opposed planar end surfaces 40 having parallel upper ends 44, which end surfaces 40 are adapted to be engaged by the opposite sides 16 of the stack 14; and arcuate friction surface portions 42 that are generally cylindrically concave about an axis parallel to the upper ends 44 of the end surfaces 40, have proximal ends at the upper ends 44 of the end surfaces 40, extend toward each other along an aligned arcuate path from the upper ends 54 of the end surfaces 40, and have spaced distal ends opposite the end surfaces 40 (e.g. spaced by about 2.44 centimeters). Opposed outlet surfaces 48 at the spaced distal ends of the arcuate surface portions 42 define an opening through the walls of the dispenser 41 between the distal ends of the arcuate friction surface portions 42 opposite the end surfaces 40.

Also like the dispenser 10, the dispenser 41 includes means adapted for arcing the stack 14 and for pressing the stack 14 toward the friction surface portions 42 to afford positioning the uppermost sheets 12 of the stack 14 along the friction surface portions 42 with the adhesive free portion of the uppermost sheet 12 in the stack 14 projecting through the opening so that by grasping that end portion the uppermost sheet 12 on the stack 14 can be manually pulled through the opening and will carry with it the adhesive free end portion of the sheet 12 beneath it in the stack 14 to which the uppermost sheet 12 is adhered by the adhesive coating, placing that adhesive free end portion in a position where it also may be grasped and pulled to withdraw the next sheet 12 from the stack 14; which friction surface portions 42 and means for arcing the stack 14 and for pressing the stack 14 being adapted to restrict sliding movement of the adhesively joined end portions of the uppermost sheet 12 and the sheet 12 beneath it between the stack 14 and the adjacent friction surface portion 42 until a predetermined force is applied to pull the uppermost sheet 12 from the stack 14, which predetermined force is greater than the force affording pealing separation between the uppermost sheet 12 and the sheet 12 beneath it by pulling only on the uppermost sheet 12 after the uppermost sheet 12 is withdrawn from the dispenser 41.

Unlike the dispenser 10, however, in the dispenser 41 that means adapted for arcing the stack 14 and for pressing the stack 14 toward the friction surface portions 42 in addition to, (or optionally, as a replacement for) the spacing and divergence of the end surfaces 40 in the manner described above for the end surfaces 20, comprises (1) a rectangular plunger or pressure member 46 having a pressure surface 47, (2) means mounting the pressure member 46 on a bottom wall included in the walls defining the cavity with the pressure surface 47 opposite the friction surface portions 42 for straight line movement in a direction generally normal to the friction surface portions 42 between an extended position (FIG. 8) with the pressure surface 47 closely adjacent the friction surface portions 42, and a retracted position (FIG. 11) with the pressure surface 47 spaced from the friction surface portions 42, and (3) means in the form of a coil spring 52 between the walls defining the cavity and the pressure member 46 for biasing the pressure member 46 toward its extended position.

The pressure member 46 has a pair of spaced parallel projecting ridges 54 partially defining the pressure surface 47 and extending parallel to the axis about which the friction surface portions 42 that are generally cylindrically concave, which ridges 54 are positioned opposite parts of the friction surface portions 42 adjacent the outlet surface portions 48.

The walls of the dispenser 41 having the opposed end surfaces 40, the concave arcuate surface portions 42, the opposed outlet surfaces 48, and a cylindrically convex bottom surface 50 opposite and spaced from the friction surface portions 42 that is defined by the bottom wall are included in a unitary structure (e.g., a polymeric molding of polystyrene), and those surfaces extend transversely entirely through the dispenser 10 parallel to the axes of the friction surface portions 42 and bottom surface 50 so that the cavity defined by those surfaces has opposite end openings opening through sides 55 of the dispenser 41; through which end openings the stack 14 can be inserted into the cavity after the pressure member 46 is manually depressed. The dispenser 41 as illustrated can thus have a transverse width less than the width of the stack 14 from which it dispenses sheets 12 (e.g., a width of 3.3 centimeters for a stack having a width parallel to its sides 16 of about 7.62 centimeters).

The dispenser 41 also includes a bottom member 56 fixed as by a suitable adhesive to the structure providing the walls of the dispenser, which bottom member includes a cylindrical guide post 58 slidably received in a cylindrical sleeve 59 included in the pressure member 46 to guide movement of the pressure member 46 between its extended and retracted positions, with the coil spring 52 that biases the pressure member 46 to its extended position positioned around the guide post 58 and sleeve 59 and applying a force between the bottom member 56 and the pressure member 46. Means in the form of rectangular foam pads 60 adhered to a base surface 61 of the bottom member 56 and having a coating of pressure sensitive adhesive on their surfaces opposite the base surface 61 that prior to use are covered with a release liner 62 are provided for adhesively anchoring the dispenser 41 to a substrate. Alternatively, the dispenser 41 could be anchored to a substrate by mechanical means, such as screws, or be made of or filled with a material of sufficient weight that the dispenser would stay in place with its base surface 61 against a horizontal surface while a sheet 12 is withdrawn from it. The dispenser 41 is also useful without such anchoring means, but typically then requires holding the dispenser 41 in one hand while a sheet 12 is withdrawn by the other.

Referring now to FIGS. 14 through 17 of the drawing, there is shown a third embodiment of a dispenser according to the present invention generally designated by the reference numeral 71.

Like the dispenser 10, the dispenser 71 is for dispensing flexible sheets 12 from a stack 14 comprising a plurality of the sheets 12 disposed one on top of another, each sheet 12 having a band of pressure sensitive adhesive coated on a minor portion of one surface adjacent one edge thereof and being free of adhesive coating on a major portion of that surface adjacent an opposite edge thereof, and the sheets 12 being stacked with the adhesive coating on each successive sheet 12 disposed along alternate opposite sides 16 of the stack 14 and releasably adhering the sheets 12 together to maintain the sheets 12 in the stack 14. Like the dispensers 10 and 41, the dispenser 71 also comprises walls having surfaces defining a cavity adapted to receive the stack 14. Those surfaces include opposed planar end surfaces 70 having parallel upper ends 74, which end surfaces 70 are adapted to be engaged by the opposite sides 16 of the stack 14; and arcuate friction surface portions 72 that are generally cylindrically concave about an axis parallel to the upper ends 74 of the end surfaces 70, extend toward each other along an aligned arcuate path from the upper ends 74 of the end surfaces 70, and have spaced ends opposite the end surfaces 70. Opposed outlet surfaces 78 at the spaced ends of the arcuate surface portions 72 define an opening through the walls of the dispenser 71 between the ends of the arcuate friction surface portions 72 opposite the end surfaces 70.

Also like the dispensers 10 and 41, the dispenser 71 includes means adapted for arcing the stack 14 and for pressing the stack 14 toward the friction surface portions 72 to afford positioning the uppermost sheets 12 of the stack 14 along the friction surface portions 72 with the adhesive free portion of the uppermost sheet 12 in the stack 14 projecting through the opening so that by grasping that end portion the uppermost sheet 12 on the stack 14 can be manually pulled through the opening and will carry with it the adhesive free end portion of the sheet 12 beneath it in the stack 14 to which the uppermost sheet 12 is adhered by the adhesive coating, placing that adhesive free end portion in a position where it also may be grasped and pulled to withdraw the next sheet 12 from the stack 14; which friction surface portions 72 and means for arcing the stack 14 and for pressing the stack 14 are adapted to restrict sliding movement of the adhesively joined end portions of the uppermost sheet 12 and the sheet 12 beneath it between the stack 14 and the adjacent friction surface portion 72 until a predetermined force (e.g. about 380 grams) is applied to pull the uppermost sheet 12 from the stack 14, which predetermined force is greater than the force affording pealing separation between the uppermost sheet 12 and the sheet 12 beneath it by pulling only on the uppermost sheet 12 after the uppermost sheet 12 is withdrawn from the dispenser 71.

In the dispenser 71 the means adapted for arcing the stack 14 and for pressing the stack 14 toward the friction surface portions 72 comprises (1) a pressure member 76 having a pressure surface 77, (2) means mounting the pressure member 76 on a bottom wall 80 included in the walls defining the cavity with the pressure surface 77 opposite the friction surface portions 72 for movement in a direction generally normal to the friction surface portions 72 between an extended position (not shown) with the pressure surface 77 closely adjacent the friction surface portions 72, and a retracted position (FIGS. 16 and 17) with the pressure surface 77 spaced from the friction surface portions 72, and (3) means in the form of a coil spring 82 between the bottom wall 80 defining the cavity and the pressure member 76 for biasing the pressure member 76 toward its extended position.

The pressure member 76 is a plate like structure having opposite outwardly projecting trunnions 84 at one end pivotably mounted in sockets in side walls adjacent the bottom wall 80 of the dispenser 71 for pivotal movement of the pressure member 76 about a pivot axis disposed at a right angle with respect to said axis parallel to the upper ends 74 of the end surfaces 70 between its retracted and extended positions. The pressure surface 77 is on an elongate portion 86 of the pressure member 76 opposite the trunnions 84 that is convex and generally arcuate both about a first pressure surface axis at a right angle to the pivot axis and about a second pressure surface axis that is parallel to the pivot axis to provide a line of contact between the pressure surface 77 and the bottom of the stack 14 of sheets 12. The pressure surface 77 is shaped so that that line of contact generally remains centered along the opening through which the sheets 12 are dispensed as the pressure member 76 moves between its retracted and extended positions.

Figure 15:
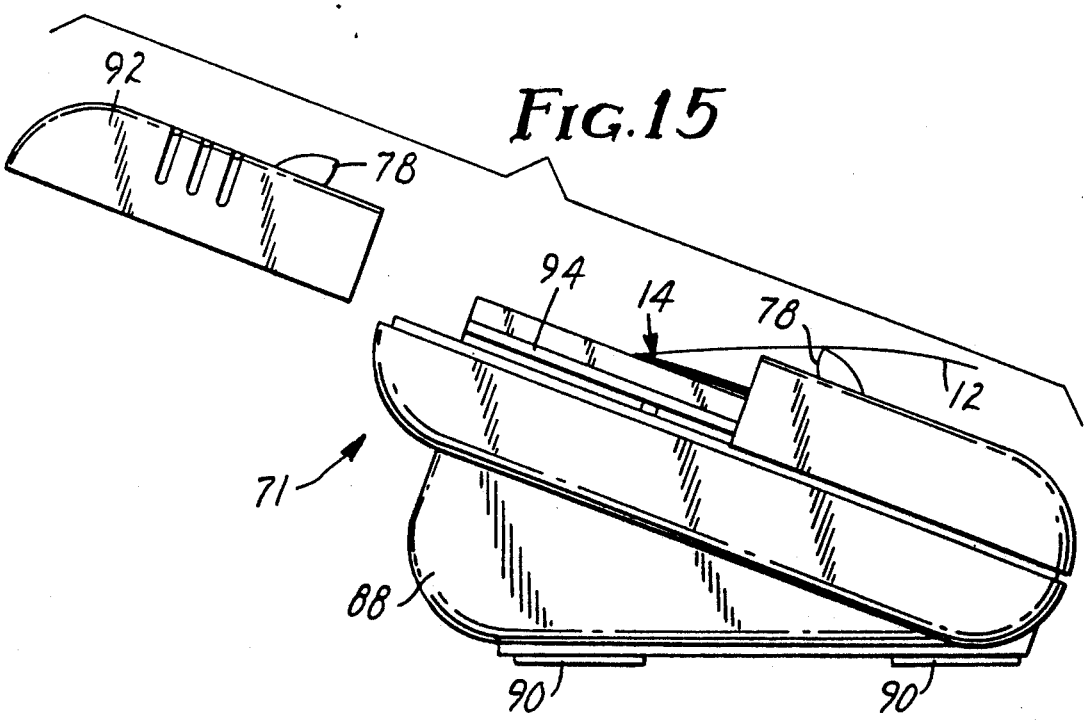
FIG. 15 illustrates removal of a housing portion of the dispenser of FIG. 14 to afford positioning a stack of sheets therein.
Figure 16:
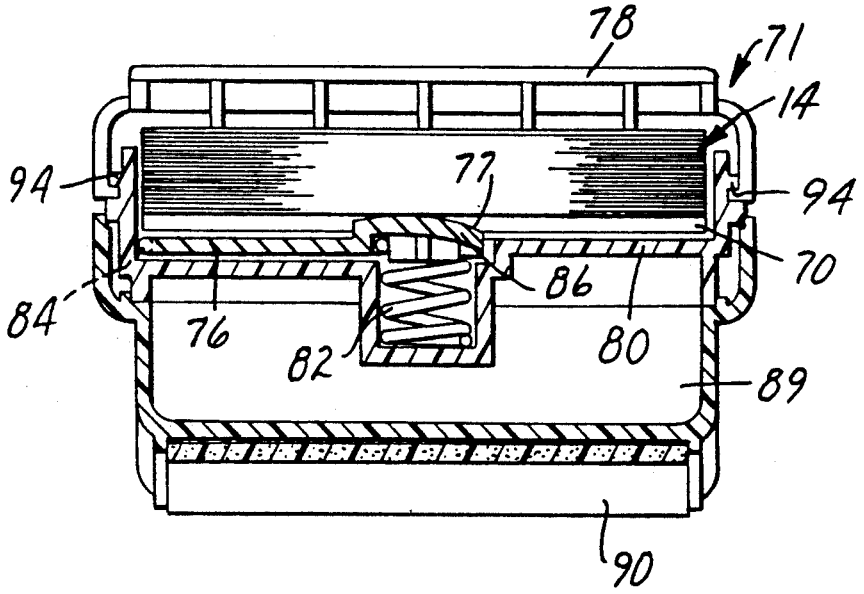
FIG. 16 is a sectional view taken approximately along line 16—16 of FIG. 14.
Figure 17:
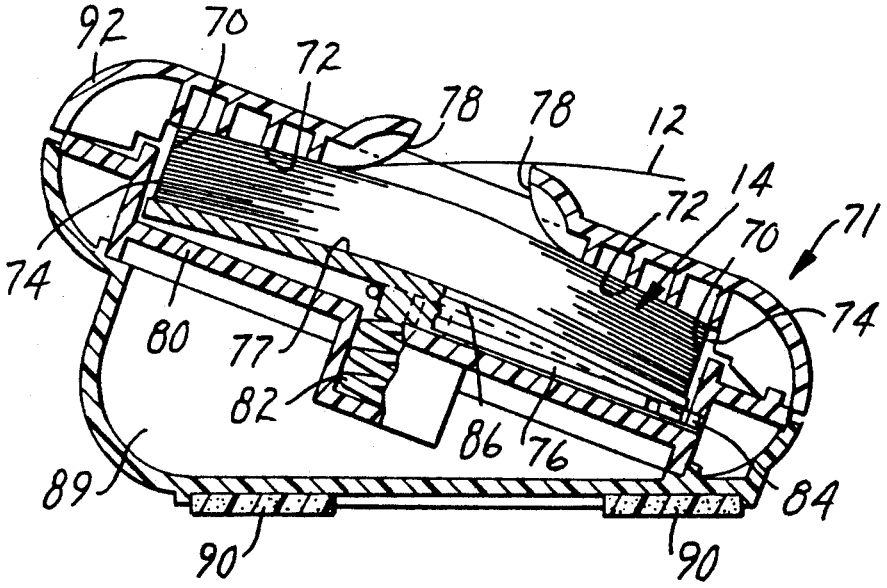
FIG. 17 is a sectional view taken approximately along line 17—17 of FIG. 14.

The walls of the dispenser 71 adapted to enclose the stack 14 of sheets 12 are included both in a main frame portion 88 that is weighted (i.e., by a heavy material in a cavity 89 therein) and has feet 90 thereon intended to rest on a horizontal surface, and a removable frame portion 92 slidably mounted by elongate parallel slide members 94 engageable between the main and removable frame portions 88 and 92. The removable frame portion 92 can be separated from the main frame portion 88 as is illustrated in FIG. 15 to afford positioning a stack 14 of sheets 12 in the dispenser 71 by pushing down the pressure member 76 against the bias of the spring 82 and retaining it there while the removable frame portion 92 is again slid into engagement with the main frame portion 88.

The present invention has now been described with reference to three embodiments thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

We claim:

1. A dispenser for flexible sheets from a stack of the sheets disposed one on top of another, each sheet having a band of pressure sensitive adhesive coated on one surface adjacent one edge thereof, being free of adhesive coating along a portion adjacent an opposite edge thereof, and having a predetermined width parallel to said edges, and the sheets being stacked with the adhesive coating on each successive sheet disposed along alternate opposite sides of the stack and releasably adhering the sheets together to maintain the sheets in the stack, said dispenser comprising:

walls having surfaces defining a cavity adapted to receive the stack, said surfaces including opposed end surfaces having generally parallel upper ends, said end surfaces being adapted to be engaged by the opposite sides of the stack, two friction surface portions extending generally toward each other from the upper ends of said end surfaces, said friction surface portions being generally arcuate and concave about an axis parallel to said upper ends of said end surfaces, and having ends opposite said end surfaces spaced from and aligned with each other, and opposed parallel outlet surfaces at the ends of the friction surface portions opposite the end surfaces defining an opening through said walls between said friction surface portions, said opening being generally centered between said end surfaces and having a width along said outlet surfaces at least as great as the width of the sheets, and means generally centered on the friction surface portions adapted for arcing the entire stack and for pressing the stack toward the friction surface portions with generally equal pressure at the two friction surface portions to afford positioning the uppermost sheets of the stack along the friction surface portions with the adhesive free portion of the uppermost sheet in the stack projecting through the opening so that by grasping that end portion the uppermost sheet on the stack can be manually pulled through the opening and will carry with it the adhesive free end portion of the sheet beneath it in the stack to which the uppermost sheet is adhered by the adhesive coating, placing that adhesive free end portion in a position where it also may be grasped and pulled to withdraw the next sheet from the stack, said friction surface portions and said means for arcing the stack and for pressing the stack being adapted to restrict sliding movement of the adhesively joined end portions of the uppermost sheet and the sheet beneath it between the stack and the adjacent friction surface portion until a predetermined force is applied to pull the uppermost sheet from the stack, which predetermined force is greater then the fore affording pealing separation between the uppermost sheet and the sheet beneath it by pulling only on the uppermost sheet after the uppermost sheet is withdrawn from the dispenser.

2. A dispenser for sheets according to claim 1 wherein said opposed end surfaces, said friction surface portions, said opposed outlet surfaces, and a bottom surface opposite and spaced from said friction surface portions extend transversely entirely through said dispenser so that said cavity has opposite end openings and the dispenser is thereby adapted to have the stack inserted into the cavity through one of the end openings.

3. A dispenser for sheets according to claim 2 wherein said dispenser has a transverse width less than the width of the stack it is adapted to receive.

4. A dispenser for sheets according to claim 1 further including means for anchoring the dispenser to a substrate.

5. A dispenser for sheets according to claim 1 wherein said means adapted for arcing the stack and for pressing the stack toward the friction surface portions comprises a pressure member having a pressure surface, means for mounting said pressure member on said walls defining the cavity with said pressure surface opposite said friction surface portions for movement in a direction generally normal to said friction surface portions between an extended position with said pressure surface closely adjacent said friction surface portions, and a retracted position with said pressure surface spaced from said friction surface portions, and means for biasing said pressure member toward said extended position.

6. A dispenser for sheets according to claim 5 wherein said walls defining the cavity include a bottom wall defining a bottom surface opposite and spaced from said friction surface portions, wherein said means for mounting said pressure member mounts said pressure member in said base wall for straight line movement between said retracted and extended positions, said means for biasing comprises a coil spring between said bottom wall and said pressure member, and said pressure member has a pair of spaced projecting ridges defining said pressure surface and extending parallel to said axis, said ridges being opposite portions of the friction surface portions adjacent said adjacent said outlet surface portions.

7. A dispenser for sheets according to claim 5 wherein said pressure member is mounted on said base wall for pivotal movement between said retracted and extended positions about a pivot axis disposed at a right angle with respect to said axis parallel to said upper ends of said end surfaces, and said pressure surface is generally arcuate both about a first pressure surface axis at a right angle to said pivot axis and about a second pressure surface axis parallel to said pivot axis to provide a line of contact between said pressure surface and the stack that generally remains centered along said opening as said pressure member moves between said retracted and extended positions.

8. A dispenser for sheets according to claim 7 wherein said walls defining the cavity include a bottom wall defining a bottom surface opposite and spaced from said friction surface portions, and wherein said means for biasing comprises a coil spring between said bottom wall and said pressure member.

9. A dispenser for sheets according to claim 1 wherein said means adapted for arcing the stack and for pressing the stack toward the friction surface portions comprises said opposed end surfaces being spaced apart a distance less than the distance between the opposite sides of the stack the dispenser is adapted to receive to arc the stack positioned with its sides against the end surfaces and to position the uppermost sheets of the stack along the friction surface portions, and said opposed end surfaces diverging slightly away from each other toward the upper ends of said end surfaces to cause movement of the end portions of the stack along said end surfaces toward said upper ends in response to forces applied to the stack to sequentially remove sheets from the stack through said opening.

10. A dispenser for sheets according to claim 9 wherein said end surfaces diverge from each other toward the upper ends of said end surfaces at an angle in the range of about 6 to 18 degrees.

11. A dispenser for sheets according to claim 9 wherein said end surfaces diverge from each other toward the upper ends of said end surfaces at an angle of about 12 degrees.

* * * * *